United States Patent [19]

Roop

[11] 4,183,530

[45] Jan. 15, 1980

[54] FOOTBALL GAME PLAYED WITH AERIAL PROJECTILES

[76] Inventor: Stephen S. Roop, 12032 Fieldwood La., Dallas, Tex. 75234

[21] Appl. No.: 911,884

[22] Filed: Jun. 2, 1978

[51] Int. Cl.[2] ..... A63F 7/06; A63B 67/04

[52] U.S. Cl. ..... 273/94 R; 273/102 B; 273/105 R

[58] Field of Search ..... 273/94 R, 94 E, 94 F, 273/102 R, 102 B, 106.5 A, 102.1 R, 105 R

[56] References Cited

U.S. PATENT DOCUMENTS

| | | | |
|---|---|---|---|
| D. 200,418 | 2/1965 | Olson | 273/102 R |
| 543,251 | 7/1895 | Jessup | 273/94 R |
| 2,227,382 | 12/1940 | Salter | 273/102 B |
| 2,276,599 | 3/1942 | Tassano | 273/94 R |

*Primary Examiner*—George J. Marlo
*Attorney, Agent, or Firm*—Sigalos & Levine

[57] ABSTRACT

Football game apparatus comprising a gameboard having thereon a visual representation of a football field including spaced lines representing at least one end zone and ten yard intervals, a plurality of first equal areas spaced within said ten yard intervals for visually representing designated defensive areas for short passes, a plurality of second equal areas smaller than and located within said first areas and representing designated defensive areas for long passes, at least one offensive play action projectile adapted to be cast at and adhere to said gameboard by an offensive player whereby the location of said play action means on said gameboard determines the movement of said offensive player towards said end zone, and a plurality of defensive means adapted to rest in selected ones of said first and second areas whereby, if an offensive play action projectile lands within an area bounded by said defensive means, a turnover is created and the defensive player becomes the offensive player. The offensive play action projectile may be (1) a dart with a point to stick to a cork gameboard, or (2) a dart with a tip of velcro material, for use with a gameboard of similar material, to which the dart will stick when tossed thereagainst.

13 Claims, 6 Drawing Figures

FOOTBALL GAME PLAYED WITH AERIAL PROJECTILES

BACKGROUND OF THE INVENTION

This invention relates to game apparatus and more particularly to a football game apparatus which utilizes objects tossed or cast towards a gameboard to determine the movement of an offensive player towards an end zone for a goal.

In football game apparatus known heretofore, it is common to employ a plurality of playing pieces in association with a gameboard, the playing pieces being movable from space to space upon the board as dictated by a change-controlled device. Simulated football games employing this principle are well known. Although such games permit utilization of playing pieces to represent the existence and movement of players on a field, it has not heretofore been possible to provide the type of realism which characterized the actual game because of the limited interrelationships of the game pieces and the limited play results available from chance-controlled devices. Such games employ pieces which merely move from space to space as determined by the throw of dice or the spinning of a spinner, for example, whereas in actual games played upon fields by human players, a wide variety of factors enter into the play results.

Prior art games have attempted to overcome this problem by employing playing pieces in association with a gameboard wherein at least some of the pieces have sets of indicia thereon related to indicia of other playing pieces and/or indicia of a chance-controlled device and, thus, the play results are influenced by the selection of particular playing pieces having particular sets of indicia, by the choice of opposing playing pieces and by chance-controlled devices having indicia correlated with the indicia of the playing pieces. Thus, in order to obtain realism in the simulated games, the apparatus and associated components thereof becomes very complicated making it difficult to play the game.

SUMMARY OF THE INVENTION

The present invention overcomes the limitations of prior game apparatus by providing a football gameboard and associated apparatus which is simple to understand and yet includes a wide degree of play variation which permits simulation of statistically realistic play results.

Briefly stated, the present invention is directed to a method of simulating a football game comprising the steps of providing a gameboard simulating a football field and having thereon transverse lines spaced to represent at least one end zone area and ten yard intervals having spaced therein a plurality of first equal areas representing designated defensive areas for short passes and second smaller equal areas located within said first areas representing designated defensive areas for long passes, providing a field goal area trapezoidal in shape with the narrow end thereof located at said end zone area and extending a predetermined distance into the field whereby as the distance of the field goal attempt increases, there is a corresponding decrease in the active area of the field goal target thereby more accurately simulating actual play, selecting an offensive play, locating eleven defensive means in predetermined ones of said first and second areas whereby, if an offensive play action means lands within an area bounded by said defensive means, a turnover is created and the defensive player becomes the offensive player and tossing an offensive play action means at said board whereby the location of said play action means on said gameboard determines the movement of an offensive player towards said end zone.

The invention also relates to football game apparatus comprising a gameboard having thereon a visual representation of a football field including spaced lines representing at least one end zone with a goal post thereon and ten yard intervals between two end zones, a plurality of first equal areas spaced in predetermined ones of said ten yard intervals and said end zone for visually representing designated defensive areas for short passes, a plurality of second equal areas smaller than and located within said first areas and representing designated defensive areas for long passes, at least one offensive play action means for being tossed at said gameboard by an offensive player whereby the location of said play action means on said gameboard determines the movement of said offensive player towards said end zone and a plurality of defensive means adapted to rest in selected ones of said first and second areas whereby, if an offensive play action means lands within an area bounded by said defensive means, a turnover is created and the defensive player becomes the offensive player.

BRIEF DESCRIPTION OF THE DRAWINGS

Further objects and advantages of the invention will become apparent from the following description and claims and from the accompanying drawings, wherein:

DETAILED DESCRIPTION

Figure 1:
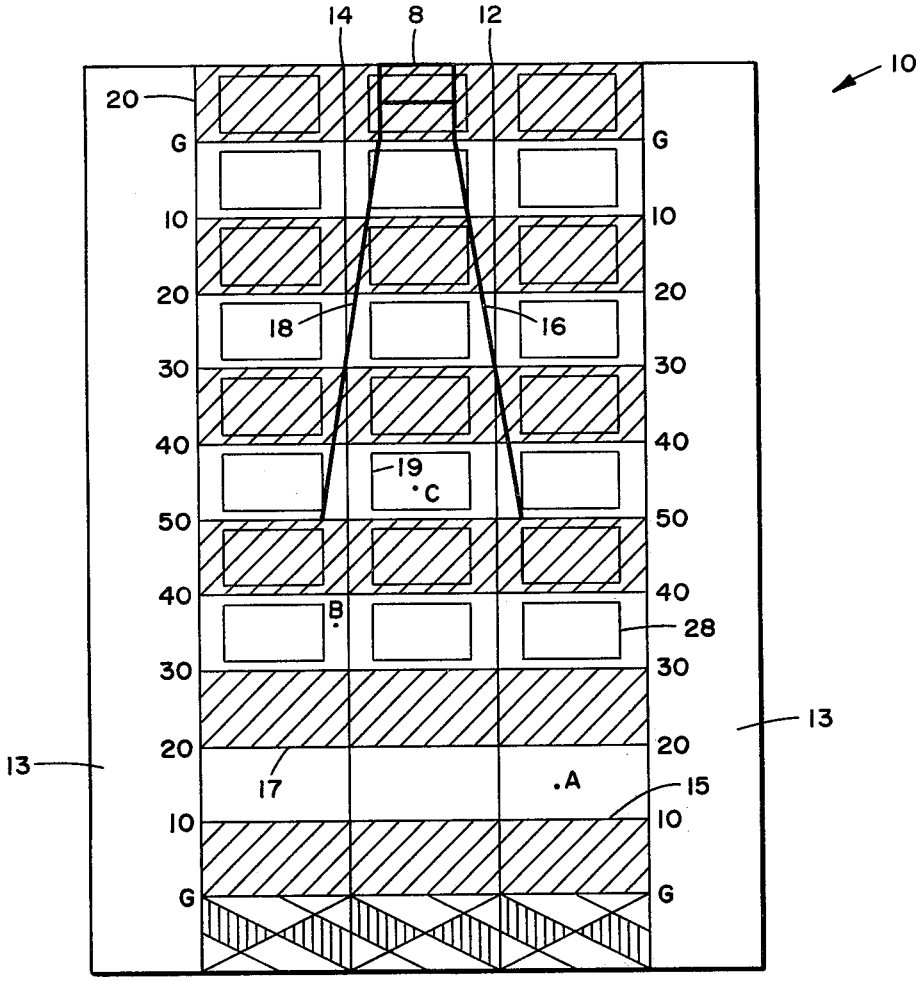
FIG. 1 is a plan view of a board marked to simulate a football field.

Referring now to the drawings in detail, wherein like numerals indicate like elements throughout the several views, FIG. 1 illustrates the plan view of the gameboard of the instant invention. The gameboard, generally represented by the numeral 10, consists of a rectangular playing surface preferably 12 inches wide and 24 inches long; however it could be of any other desired dimensions. The outside dimensions of the entire board are preferably 18 inches by 24 inches although, again, any other desired dimensions could be used. With the preferred dimensions as set forth, a three inch out of bounds region 13 exists on either side of the field. The board can be made of cork or any other suitable material.

The field is divided in the following manner: eleven 12 inch horizontal lines, two inches apart, which coincide with and represent yard lines in multiples of ten on an actual football field. The yard lines are marked on the out of bounds region 13 on either side of the field. Both end zones, designated by the line G are included as is a goal post 8.

The playing field is further divided by longitudinal lines 12 and 14 which are located four inches from either side line and span the length of the field to separate it into equal thirds measuring four inches by twenty four inches in the preferred embodiment.

The field-goal target consists of a two and one-half by two inch section of the end zone 20 and then spreading out from the goal line to a five inch width at the fifty yard line where it ends. The outer boundaries thereof are designated by lines 16 and 18 in FIG. 1.

Both players advance toward and try to score in the upper, active end zone 20. The players therefore must always orient the offensive line of scrimmage in accordance with the opposition's end zone which is always the upper end zone 20. This orientation occurs after each possession and is accomplished by simply moving the yard line marker, not shown, to the corresponding yard line on the opposite end of the field. Thus, if a turn-over occurs at the ten yard line, the yard line marker, not shown, is moved to the ten yard line of the offensive player at the bottom of the board designated by the numeral 15.

The lower end zone is oriented towards the player on offense. The defensive player should position himself within reaching distance of the board so that he can position the means representing the defensive players.

An offensive play is made by tossing an offensive play action means at the gameboard. The offensive play action means may be a dart with a point to stick to a cork board, a dart with a tip of Velcro material and a gameboard of corresponding material or any other suitable device which, when tossed, will stick to the gameboard.

Figure 2:
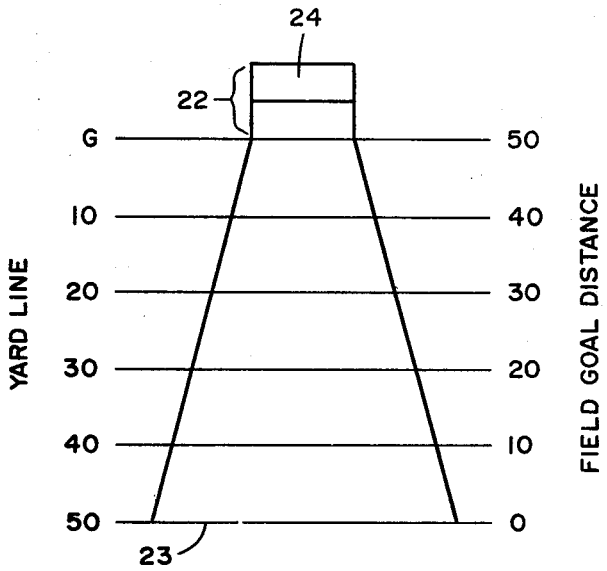
FIG. 2 is a plan view of the details of the field-goal target.

FIG. 2 is a plan view of the details of the field goal target. It is obvious that in actual football, the further the kicker is from the goal post the more difficult it is to obtain a field goal and, conversely, the closer he is to the goal post, the easier it is to obtain a field goal. Consequently, on the gameboard of the present invention is placed a field goal target shown in FIG. 2 which, as stated earlier, consists of a two and one-half by two inch section 22 which is in the active end zone and then includes a trapezoidal field goal area which spreads out from the goal line to a width of five inches along the fifty yard line designated by the numeral 23 in FIG. 2. Field goals up to sixty yards may be attempted. When a field goal is attempted from the goal line, the entire field goal target is active (a field goal distance of 0 as indicated on the right side of FIG. 2). That simply means it is easier to throw the offensive play action means, hereinafter called "dart", into the area of the field goal target out to and including the fifty yard line as shown in FIG. 2. As the distance from the goal line increases by multiples of ten the active area of the target decreases by multiples of ten. A field goal attempt from the ten yard line (as indicated on the right side of FIG. 2) would, therefore, have to hit in the field goal target inside the forty yard line (as indicated on the left side of FIG. 2). A field goal from the twenty yard line must hit inside the field goal target above the thirty yard line and so forth. The only exception to this rule occurs when the maximum length of the field goal attempt is sixty yards and the dart must hit in the portion of the field goal target in the upper half of the end zone designated by the numeral twenty four which is an area of one inch by two and one-half inches. Unsuccessful attempts at field goals are returned to play by the opposing team at the location dictated by football regulations whether pro football or college.

The players can determine who is to "kick off" by any method such as tossing a coin. A kick off occurs at the beginning of the contest, start of the second half or after a score. The player kicking off throws a single dart for placement that determines where the opponent begins possession. The dart must land beyond the fifty yard line in the defensive zone and a throw not meeting this qualification is allowed over. Position of the dart on the field determines where the opponent takes possession. Thus a dart into the end zone or beyond results in a touchback and beginning possession at the twenty yard line designated by the numeral 17 in FIG. 1. A dart between the ten yard line and the goal line in the defensive zone forces the opponent to begin at the ten yard line in the offensive zone designated by the numeral 15 in FIG. 1 between the twenty yard line and the ten yard line allows possession at the twenty yard line 17 and so forth.

The rules of the game are as follows:

1. DOWNS.

With a first down the offensive player is provided four darts to advance his position. These darts correspond to the four downs in football. Advancement occurs in a minimum of ten yard (two inch) segments and on any given play consists of landing a dart within the ten yard area immediately above the line of scrimmage. Thus, a first down follows each advancement. For example, assume that the offensive player has a first down at his ten yard line 15 shown in FIG. 1. His task is to land a dart in the area between the ten and twenty yard lines 15 and 17 respectively shown in FIG. 1. If the first two attempts land at points other than between the ten and twenty yard lines 15 and 17 respectively, the offensive player is faced with a third down at the ten yard line. If the next throw lands at a point between the ten and twenty yard lines, advancement would be to the twenty yard line 17. This type of play is the offensive "rushing" play.

2. FREE DARTS.

With a successful throw for a first down, the offensive player earns a "free dart" which makes continued advancement on a specific play, such as a twenty yard run or a touchdown run, possible. Thus, in FIG. 1, following the successful third down throw of the dart to the area between the ten and twenty yard line, the free dart is aimed for the next successive ten yard area, i.e., between the twenty and thirty yard lines. If the offensive player is successful on this attempt, he traverses another ten yard area and still another free dart is earned. As long as successive ten yard areas are hit with the dart, the play and advancement of the offense continues. Thus, a touchdown run can be made. If a free dart is missed, the offensive player receives a first down from the yard line above the point of the last successful dart. Thus, if the last successful free dart landed between the forty and fifty yard lines, and the next free dart did not land in the area between the fifty and forty yard line in the defensive zone, a first down is obtained on the fifty yard line and four more darts are obtained. Free darts are earned on several occasions but regardless of the type of play, they continue in succession until the offensive player either scores or misses the next successive ten yard area with the dart.

3. MOVEMENT OF OFFENSE.

a. Short Passes.

Short passes are a second offensive play and can be made for ten, twenty or thirty yards. As indicated earlier, vertical lines 12 and 14 divide each ten yard area into equal thirds measuring two inches by four inches in the preferred embodiment. Each of these two inch by four inch areas within thirty yards of scrimmage may become, if orally indicated, a distinct target for a short pass. The offensive player has the option therefore on any down to select any one of the nine such areas within range for a short pass. Thus, in FIG. 1, if the offensive player has the ball at the twenty yard line (assuming dart lands at any point A between the ten and twenty yard lines), he may select for a short pass any of the nine two inch by four inch rectangles lying between the twenty and the fifty yard line. However, to complete the short pass he must throw the dart so that it lands in the particular rectangle which he has previously orally designated for the short pass. Thus, if he called out the rectangle in which the location B is identified, he must throw the dart so that it lands in that particular rectangle. If he misses, the play is an incomplete pass.

b. Long Passes.

Long passes are a third offensive play and passes of forty or fifty yards may be made. The target areas for long passes are the one and one-half inch by three inch rectangles located concentrically within the first areas that are two by four inches. One such second area is designated by the numeral 28 in FIG. 1. This feature provides a trade off between smaller target areas and longer gain. In other words if an offensive player wishes to attempt to make longer yardage, a more difficult play is involved and he must throw the dart into a smaller preselected area than he would for a short pass. Since long passes are limited to forty or fifty yards, the offensive player has the option on any down to select any one of the six such areas within range. Thus, if the offensive player were located at the twenty yard line (again assuming the dart lands anywhere between the ten and twenty yard lines such as point A in FIG. 1), for a long pass he could select any one of the six smaller second areas located between the fifty yard line and the thirty yard line in the defensive territory. If, for instance, he selected the smaller second area 19 having a point therein designated as C in FIG. 1, the dart would have to land in the smaller second area 19 designated in order for the long pass to be completed. If the dart does not land in second, smaller area 19, the pass is incomplete.

c. Procedure.

A passing down is preceeded by a verbal indication from the offensive player stating which specific target area is intended on that play and whether or not the pass is a long pass or a short pass. Two designations are used in defining a specific target area. The first is the yard line to which the pass is to be completed, that is, the yard line directly above the target area, and the second is the position of the target in the ten yard area, that is, right, center or left. The designation of the area 19 in which the letter C is located in FIG. 1 would be defined "forty, center".

d. Pass-run combinations.

A completed pass earns the offensive player a free dart and possible continued advancement on the play. The free dart must then hit within the next ten yard area immediately beyond the ten yard area in which the pass was completed. In other words if a pass were completed to point C in FIG. 1, the free dart earned must hit in the next ten yard area between the forty and the thirty yard line in the defensive area. As in other cases, with each successful free dart, another is earned until the succession is broken or a touchdown is made.

4. SCORING.

a. Touchdowns.

A six point score results from any penetration of the active end zone area 20 following proper advancement of the offense. Proper advancement consists of movement resulting from successive gains, whether by rushing, passing or any combination thereof.

b. Field goals.

A field goal is a fourth offensive play and goals up to sixty yards may be attempted. As the distance of the attempt increases there is a corresponding decrease in the active area of the field goal target. When a field goal is attempted from the goal line, the entire field goal target shown in FIG. 2 is active. As distance from the goal line increases by multiples of ten, the active area of the target decreases by multiples of ten. A field goal attempt from the ten yard line would, therefore have to hit in the field goal target inside the forty yard line. A field goal from the twenty yard line must hit inside the target above the thirty yard line, and so forth.

The only exception to this relationship occurs with a maximum length field goal attempt (sixty yards) is made and the dart must hit in the portion of the field goal target in the upper half of the end zone (an area of one inch by two and one-half inches in the preferred embodiment). Unsuccessful attempts are returned to play by the opposing team at the location dictated by football rules, either pro football or college, depending upon which rules are being followed.

c. Extra points.

1. Point after touchdown.

A successful kick after touchdown, into any part of the field goal target is an extra point. In other words, it is exactly the same as a field goal from the goal line.

2. Two point conversions.

This requires a successful throw, after touchdown, into any part of the end zone. This would be equivalent to rushing during the regular game. In other words, it is equivalent to throwing the dart into the next succeeding ten yard zone during normal game play.

5. PUNTING-KICKING GAME.

a. Punts.

1. Automatic punts.

Punts from within the offensive player's own territory are utilized as a field position play. As such they are verbal and standarized in length. Thus, a player deciding to punt from anywhere outside the fifty yard line (in the offensive area) simply indicates this intention verbally and moves the line of scrimmage fifty yards in the offensive direction. After reorientation of the line of scrimmage, the defensive player takes possession. Thus, if the offensive player is on his own ten yard line (designated by the numeral 15 in FIG. 1) and punts, he indicates his intention to punt and moves the line of scrimmage to the forty yard line in the defensive game. The defensive player takes over and moves the scrimmage line to the forty yard line in the offensive zone.

2. Coffin-corner punts.

Punts from the fifty yard line or inside opposition territory form a fifth offensive play and are accomplished by throwing a single dart. The position of the dart on the field determines where the opponent takes possession. A dart into the end zone or beyond results in a touchback and beginning possession at the twenty yard line. A dart between the ten yard line and the goal line forces the opponent to begin at the ten, between the twenty yard line and the ten yard line allows possession at the twenty and so forth.

b. Kick-off.

A kick-off occurs at the beginning of the contest, start of the second half and after a score. The player kicking off throws a single dart for placement that determines where the opponent begins possession. The dart must land beyond the fifty yard line (a throw not meeting this qualification is allowed over). Point of return is determined as in coffin-corner punting.

6. RETURNS.

a. Punt returns.

Following a punt (automatic or coffin-corner) the field orientation is changed to accommodate the change in possession. Punt returns consist of an initial free dart that must land in the ten yard area immediately above the new line of scrimmage. An exception to this rule occurs for those punts landing in the end zone. Returns from the end zone are optional. The player can decide to have the punt brought to the twenty for a first down or he could run it if he so desired. If he decides to run, as long as successive ten yard areas are hit, the return continues until either the succession is broken or a touchdown is made.

b. Kick-off returns.

Kick-off returns consists of an initial free dart that must hit inside the ten yard area immediately above the established line of scrimmage. As in punt returns, successive ten yard areas become the active targets and the return continues until the succession is broken or a touchdown is made.

7. DEFENSE.

a. General description.

Figure 4:
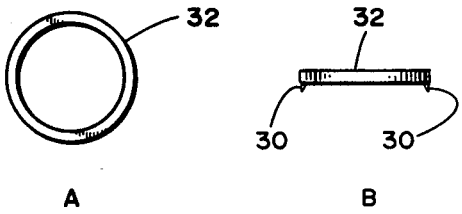
FIG. 4A is a plan view of means representing a defensive player wherein the means in this case is in the form of a ring and FIG. 4B is a side view of the ring illustrating fingers extending therefrom to hold the ring in place on the gameboard.

In the preferred embodiment, eleven rings, each one inch in diameter are distributed across the field to serve as indicia representing defensive men. While the preferred defensive means are rings, obviously other shapes could be used and other materials such as Velcro fabric or other adhering material could be used. Hereinafter, the defensive means will be referred to as "rings" for the preferred embodiment. The defensive player is responsible for the distribution of the rings and their movement. Any throw, excluding kicks, inside a defensive ring is a defensive play. This simply means that there is a turnover and the ball now belongs to the defense. The type of play, whether fumble or interception, is determined by the intent of the offensive player. In other words, if the offensive player has just called a rush play and the dart lands within the defensive ring, the play is a fumble and the ball belongs to the defense. If the offensive player has just called a pass play and the dart lands within a defensive ring, the play is an interception and the ball belongs to the defense. FIG. 4A discloses a ring 32 that may be used as a defensive player. FIG. 4B is a side view of the ring 32 illustrating fingers 30 which may be used to hold the rings in place on the board during play. Obviously, any other means which would hold the ring in place may be used.

b. Distribution.

Figure 5:
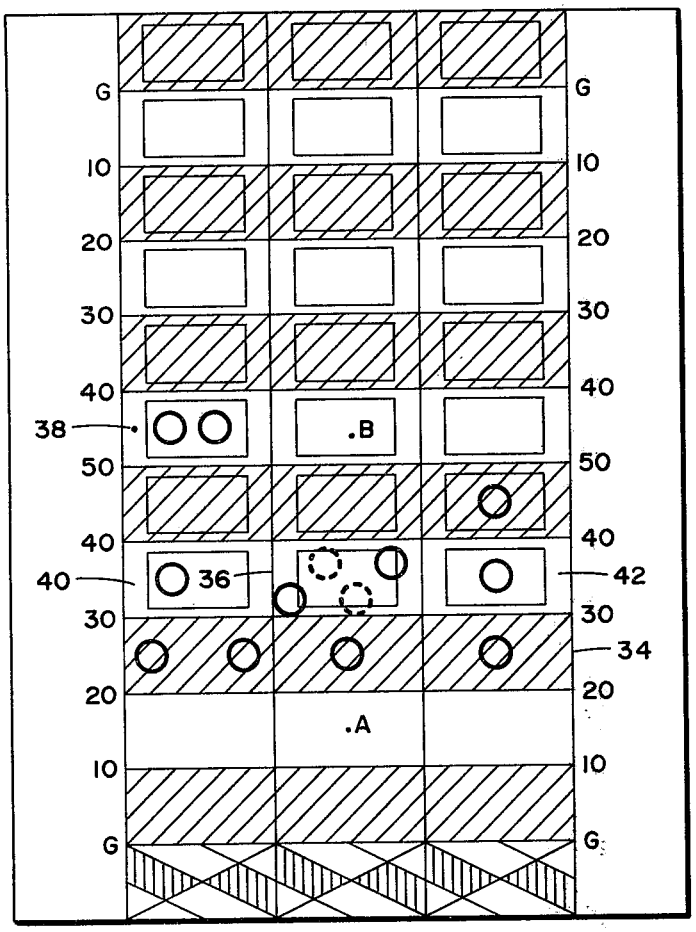
FIG. 5 is a plan view of the board illustrating the manner in which the defensive players in the form of the rings shown in FIG. 4 can be placed upon the gameboard.

No more than four rings may be placed inside any given ten yard area. Thus, as shown in FIG. 5, four rings have been placed between the twenty and thirty yard lines in the zone generally designated by the numeral 34. However, four rings may not be placed inside any one of said first areas in a given ten yard area. Thus, as shown in FIG. 5, the four rings placed within one of said first areas designated by the numeral 36 between the thirty and the forty yard lines are improper. No more than two rings may be placed inside any one of said first areas such as is shown in the area designated by the numeral 18 between the fifty yard and the forty yard line on the defensive territory. Other than these restrictions, any area on the playing field may be defended.

c. Movement.

The defense is set by the defensive player for an entire offensive series and reset before a return run.

1. Pass defense.

When the offensive player indicates a pass to an undefended target area, the defensive player has an option to place one defensive ring in that area. Thus, in FIG. 5, assume that the two dashed rings are not present in the center first area 36 between the thirty and forty yard lines and are instead placed in the right and left first areas 40 and 42 as shown. Assume also that the offensive player is located at the twenty yard line (assume the dart landed at point A in FIG. 5) and calls a long pass to "forty, center" at point B. The defense has an option of taking one of its defensive men and placing it in the area designated "forty, center".

d. Defensive plays.

1. Fumbles.

Any penetration of a defensive ring during play, excluding plays preceeded by a verbal indication of pass or kick, is a fumble and fumbles may not be returned. The defensive player simply takes possession at the next highest yard line and reorients his position to the offensive side of the gameboard.

2. Interceptions.

Penetration of a defensive ring after an indication to pass is an interception. Pass interceptions may be returned in the same manner as a punt or kick return. That is, the defensive player is then given a free dart and must put it inside the ten yard area above the point of interception after the board has been reoriented.

3. Inactive.

The defense is considered inactive during field goal attempts, kick-offs, and coffin-corner punts.

9. Length of Game.

If it is desired to simulate yardage in an actual game, each player should be allowed twelve possessions. If it is desired to simulate average points made in an actual game, each player should have sixteen possessions.

10. Handicaps.

The distance from the board at which the darts are thrown should vary with skill at throwing darts.

Figure 3:
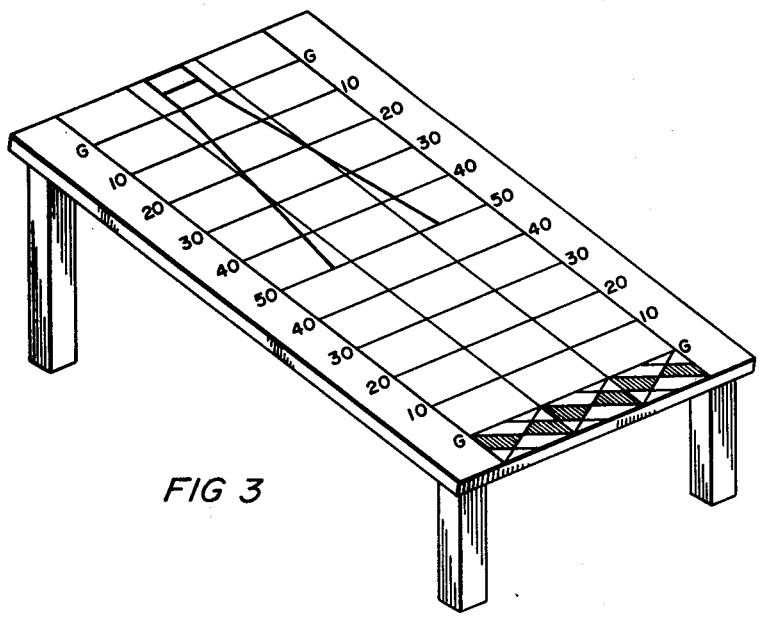
FIG. 3 is a perspective view of the gameboard mounted on legs with the bottom of the board having shorter legs than the top of the board so that the board rests at an angle on the legs.

The novel board game may be played with the board in a vertical position such as hanging on a wall or in a horizontal position preferably with a slight tilt as shown in FIG. 3. The front legs in the preferred embodiment should be approximately fifteen inches high and the rear legs approximately twenty-two inches high in such case.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. Football game apparatus comprising:

(a) a game board having thereon a visual representation of a football field including spaced lines representing at least one end zone and ten yard intervals, (b) a plurality of first equal areas spaced within said ten yard intervals and said end zone visually representing designated defensive areas for short passes, (c) a plurality of second equal areas smaller than and located within designated ones of said first areas and representing designated defensive areas for long passes, (d) at least one offensive play action means for being cast at said gameboard by an offensive player whereby the location of said offensive play action means on said gameboard determines the movement of said offensive player toward said end zone and (e) a plurality of defensive means adapted to rest in selected ones of said first and second areas whereby, if an offensive play action means lands within an area bounded by said defensive means, a turnover is created and the defensive player becomes the offensive player.

2. Football game apparatus as in claim 1 further including:

(a) A visual representation of a goal post located in said end zone.

3. A football game apparatus as in claim 2 further including;

(a) a visual representation of a trapezoidal field goal area on said gameboard with the narrow end thereof terminating at said goal line and extending across the end zone to said goal post and the larger end extending a predetermined distance into said field whereby as the distance of the field goal attempt increases there is a corresponding decrease in the active area of the field goal target thereby more accurately simulating an actual field goal play.

4. A football game apparatus as in claim 3 wherein said defensive means representing defensive players comprises:

(a) circular rings.

5. Football game apparatus as in claim 4 wherein:

(a) said offensive play action means is a dart that sticks to said gameboard.

6. A method of simulating a football game comprising the steps of:

(a) providing a game board simulating a football field and having thereon transverse lines spaced to represent at least one end zone area and ten yard intervals, (b) designating visually a plurality of first equal areas spaced within said ten yard intervals and said end zone representing designated defensive areas for short passes, (c) designating visually second smaller equal areas located in predetermined ones of said first areas representing designated defensive areas for long passes, (d) providing a field goal area trapezoidal in shape with the narrow end thereof located at said goal line and extending across said end zone and the larger end extending a predetermined distance into the field whereby as the distance of the field goal attempt increases, there is a corresponding decrease in the active area of the field goal target thereby more accurately simulating actual play, (e) selecting an offensive play, (f) locating eleven defensive means in predetermined ones of said first and second areas and, (g) tossing an offensive play action means at said board whereby the location of said offensive play action means on said gameboard determines the movement of an offensive player towards said end zone.

7. A method of simulating a football game as in claim 6 wherein said offensive plays are selected from the group comprising:

(a) rushing, (b) short passes, (c) long passes, (d) punts, and (e) field goals.

8. A method of simulating a football game as in claim 7 further including the step of:

(a) creating a turnover whenever said offensive play action means lands within an area bounded by said defensive means, said turnover being (i) a fumble during a ground rush play or (ii) an interception during a pass play.

9. A method of simulating a football game as in claim 8 further including the steps of:

(a) limiting the number of defensive means that may be placed inside any given ten yard zone to four, and (b) limiting the number of defensive means that may be placed within any one of said first equal areas to two.

10. A method of simulating a football game as in claim 9 further including the step of:

(a) limiting the number of defensive means that may be placed in an undefended said first or second area to one whenever the offensive player indicates a pass to that undefended area.

11. A method of simulating a football game as in claim 10 further including the step of:

(a) providing four offensive play action means for an offensive player representing four downs in an actual football game.

12. A method of simulating a football game as in claim 10 including the step of:

(a) limiting the length of a game to (i) twelve possessions per player to simulate average yardage achieved in an actual football game and (ii) sixteen possessions per player to simulate average points attained in an actual football game.

13. A method of simulating a football game as in claim 12 wherein the step of locating defensive means comprises:

(a) positioning circular means having a predetermined diameter in predetermined ones of said first and second areas.

* * * * *